United States Patent [19]

Ishida et al.

[11] 4,062,113

[45] Dec. 13, 1977

[54] SCISSORS WITH SHEATH TYPE REPLACEABLE BLADES

[75] Inventors: Minoru Ishida, Gifu; Kenzi Komiyama, Seki, both of Japan

[73] Assignee: Feather Safety Razor Co., Ltd., Osaka, Japan

[21] Appl. No.: 753,142

[22] Filed: Dec. 21, 1976

[30] Foreign Application Priority Data

Dec. 30, 1975 Japan ..... 51-177183[U]

[51] Int. Cl.[2] ..... B26B 13/04

[52] U.S. Cl. ..... 30/260

[58] Field of Search ..... 30/260, 349

[56] References Cited

U.S. PATENT DOCUMENTS

| | | | |
|---|---|---|---|
| 1,645,035 | 10/1927 | Zeidler | 30/260 |
| 1,778,346 | 10/1930 | Zeidler | 30/349 |
| 1,783,583 | 12/1930 | Ralston | 30/260 |
| 1,956,588 | 5/1934 | Parker | 30/260 |
| 2,725,629 | 12/1955 | Todhunter | 30/260 |

*Primary Examiner*—Jimmy C. Peters

*Attorney, Agent, or Firm*—Pollock, Vande Sande & Priddy

[57] ABSTRACT

A scissors with replacable sheath type blades which is fitted over the protrusions provided at the portions in front of the pivot of the pair of components of scissors. With a round depression in the outer side near the pivot of each protrusion and with a boss having spring action projected into the space formed by the blade and sheath outer member of the sheath type replacable blade, the scissors with sheath type replacable blades with stable fit which is convenient in use and handling is obtained by fitting the boss of the replacable blade in the depression of the protrusion.

6 Claims, 7 Drawing Figures

SCISSORS WITH SHEATH TYPE REPLACEABLE BLADES

BACKGROUND OF THE INVENTION

This invention relates to a scissors with sheath type replacable blades for exchange with new spare blades for the scissors, without requiring regrinding work and time.

In the prior art relating to scissors having sheath type replacable blades, such scissors are provided with a tongue type protrusion, and an extension of the blade forming the sheath portion of the replacable blade is fastened to the pivot portion of the pair of handled components of the scissors with a screw. Such type of scissors, however, has the following defects: it requirs a tool such as a driver for replacement, and this is not only troublesome but also has a possibility of injuring fingers with the cutting blades during replacement because of the disassembly of the instrument.

Therefore, a novel cutting blade replacable scissors which would eliminate these defects, ensure simple and stable fitting, and enable safe replacement of the cutting blades is highly desirable.

SUMMARY OF THE INVENTION

According to this invention, a round depression is formed in the protrusion for fitting in the front portion of a pair of components of a scissors, and a boss which is projected into a vacant space formed by a sheath outer member and a blade which is welded to flanges on both sides of the sheath outer member is provided. With these provisions, a sheath type blade replacable scissors can be obtained as the boss snaps into the depression when the protrusion for fitting is inserted into the vacant space of the replacable blade.

The primary object of this invention is to offer a scissors with sheath-type replacable cutting blades, convenient in use and handling, esuring simple and stable fit and easy and safe replacement of the cutting blades.

The secondary object of the invention is to offer a scissors with sheath type replacable cutting blades, which can be simply yet steadily fitted and readily and safely replaced, to be mass produced at low cost by spot-welding both flange ends of the sheath outer member to the cutting blade (or the sheath inner member) to make the replacable blade.

The above and other object, feature and advantages of the present invention will become apparent from the following description of preferred embodiments thereof taken in conjunction with the accompanying drawings.

DESCRIPTION OF THE PREFERRED EMBODIMENT

Figure 1:
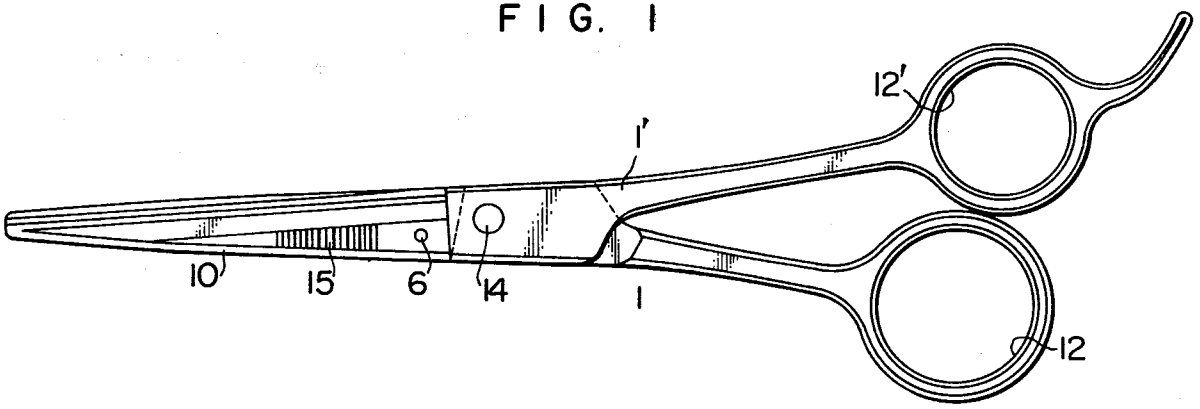
FIG. 1 is a plane view of a scissors with sheath type replacable cutting blades in accordance with this invention.
Figure 2:
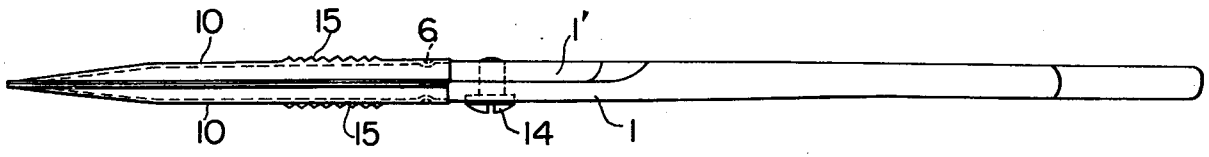
FIG. 2 is an elevational view thereof.
Figure 3:
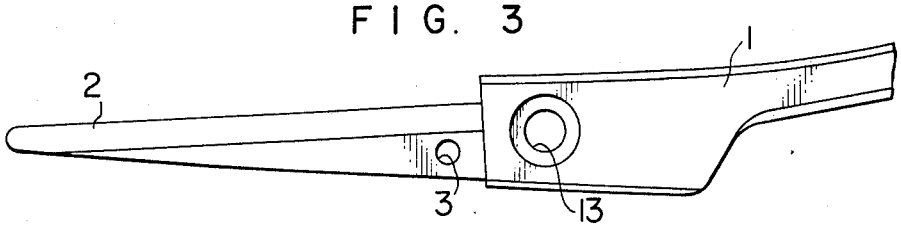
FIG. 3 is a plan wiew, with a portion broken away, of a component of the scissors.
Figure 4:
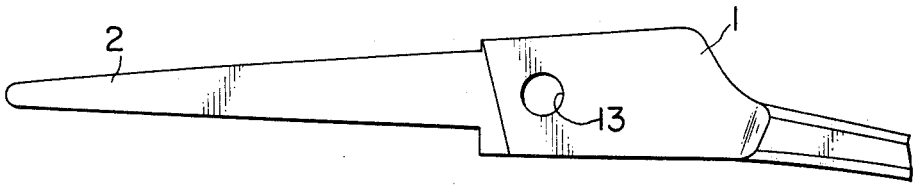
FIG. 4 is a view from the bottom thereof.
Figure 5:
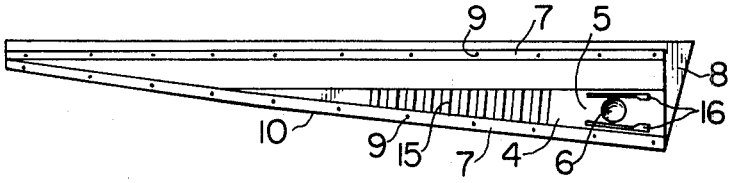
FIG. 5 is a plan view of the replacable blade and sheath in accordance with this invention.
Figure 6:
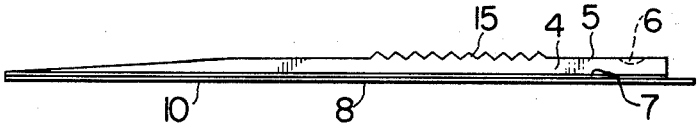
FIG. 6 is an elevational view thereof.
Figure 7:
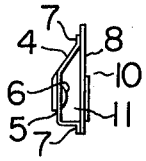
FIG. 7 is a view looking from the right side thereof.

Referring now to the drawings, FIG. 1 through FIG. 7, a preferred embodiment of this invention is described. At each front portion of the pair of component parts 1 and 1' of the scissors a tang type protrusion 2 is provided. A round depression 3 is formed in the outer side of each part 1, 1' at the base of said protrusion 2. A press-shaped sheath outer member 4, having in its top surface 5 at the base a boss 6 protruding inwardly for fitting, is placed with the flanges on both sides 7 and 7' flat on and welded to a blade 8 to form a sheath type replacable blade 10. 9 are spot welds. When the abovementioned tang type protrusion 2 is inserted in the space 11 of the replacable blade 10, the boss 6 engages the said round depression. In this way, the replacable blade 10 is freely attachable to and detachable from the scissor components 1 and 1'. The round depression 3 may be made in any other form, as long as such depression is large and deep enough to receive the boss 6.

In the drawing, 12 and 12' are the handles in which the fingers of a hand are inserted. Handle 12 together with part 1 make up a moving part and 12' and 1' make up a stationary part. Pivot holes 13 and 14 receive a pivot screw for the respective components of the scissors. Knurls 15 are provided on the front portion of the top surface 5 for a firm hold. Slits 16 are provided in the top surface 5 at the both sides of the boss 6 to provide spring action of the boss 6. The sheath outer member 4 and blade 8 are fixed together by spot-welding at the spot welds 9 spaced at predetermined distances on the contacting flange. The tang-type protrusion 2 is made in a form that corresponds to space 11.

This invention, having the structure as described above enables the tang-type protrusion 2 of the components of the scissors to be inserted into the spaces 11 of the replacable blades 10 so that the boss 6 may fit in the depression 3. The replacable blades 10 may thus be freely attachable and detachable to and from the components of the scissors 1 and 1', while providing a simple yet proper fit, so as to make assembly, use and handling convenient.

What is claimed is:

1. A scissors with sheath type replacable blades, comprising a pair of components of the scissors, each provided at its one end portion with a tang-type fitting extension and having therein a depression and sheath type replacable blades, each comprising a sheath outer member and a blade, said sheath outer member including a pair of flange portions and supporting on its inner surface an inwardly protruding boss, said flange portions of said sheath outer member being secured to said blade member to define an enclosed space for receiving said blade, said boss being received in said depression when said blade is fully received into said space.

2. A scissors with sheath type replacable blades as set forth in claim 1, wherein said blade is spot-welded to the flanges on both sides of said sheath outer member.

3. A scissors with sheath type replacable blades as set forth in claim 2, wherein the depression provided in each said scissors component and the inwardly projecting boss provided in the inner surface of the sheath outer member are positioned at the base portions of the outer side of said extension and of the inner surface of the said sheath outer member respectively.

4. A scissors with sheath type replacable blades as set forth in claim 3, wherein knurls are provided on the front portion of the top surface of the sheath outer member.

5. A scissors with sheath type replacable blades as set forth in claim 4, wherein the surface of the sheath outer member has a pair of slits at both sides of the boss.

6. A scissors with sheath type replacable blades as set forth in claim 5, wherein the protrusion and the space are of a similar form.

* * * * *